US005558891A

United States Patent [19]

Lawless et al.

[11] Patent Number: 5,558,891

[45] **Date of Patent: * Sep. 24, 1996**

[54] PACKAGING OF THINLY SLICED MEATS

[75] Inventors: Brian P. Lawless; Heidi A. Schmidt; Gary G. Winchester, all of Madison; Kenneth E. Woode, DeForest, all of Wis.

[73] Assignee: Kraft Foods, Inc., Northfield, Ill.

[ * ] Notice: The term of this patent shall not extend beyond the expiration date of Pat. No. 5,395,632.

[21] Appl. No.: 367,000

[22] Filed: Dec. 30, 1994

Related U.S. Application Data

[63] Continuation of Ser. No. 696,327, Apr. 30, 1991, Pat. No. 5,395,632, which is a continuation of Ser. No. 505,329, Apr. 5, 1990, abandoned.

[51] Int. Cl.[6] ..... B65D 85/00

[52] U.S. Cl. ..... 426/129; 53/447; 53/540; 426/397; 426/410

[58] Field of Search ..... 426/129, 130, 426/128, 127, 106; 206/484; 53/116, 247, 243, 447, 448, 540, 531, 532

[56] References Cited

U.S. PATENT DOCUMENTS

| | | | |
|---|---|---|---|
| D. 299,085 | 12/1988 | Martinez . | |
| 2,596,514 | 5/1952 | Uehlein | 426/121 |
| 2,793,745 | 5/1957 | Cox, Jr. . | |
| 3,051,583 | 8/1962 | Tindall | 426/129 |
| 3,191,849 | 6/1965 | Gutowski et al. | 206/484 |
| 3,338,723 | 8/1967 | Lundquist . | |
| 3,371,848 | 3/1968 | Ward et al. . | |
| 3,467,244 | 9/1969 | Mahaffy et al. . | |
| 3,556,337 | 1/1971 | Harmon et al. | 426/129 |
| 3,647,485 | 3/1972 | Seiferth et al. . | |
| 4,018,905 | 4/1977 | Adamek et al. . | |
| 4,246,288 | 1/1981 | Sanborn, Jr. . | |
| 4,599,849 | 7/1986 | Lundstrom | 53/116 |
| 4,691,820 | 9/1987 | Martinez . | |
| 4,866,911 | 9/1989 | Grindrod et al. | 426/129 |
| 5,405,629 | 4/1995 | Marnocha et al. | 426/129 |
| 5,445,838 | 8/1995 | Lipinski et al. | 426/129 |

FOREIGN PATENT DOCUMENTS

| | | |
|---|---|---|
| 385323 | 9/1990 | European Pat. Off. . |
| 450958 | 10/1991 | European Pat. Off. . |
| 452052 | 10/1991 | European Pat. Off. . |
| 1544040 | 9/1968 | France . |

OTHER PUBLICATIONS

W. Gisslen, Professional–Cooking, 1989, 3rd Ed. John Wiley & Sons, Inc. New York, p. 528.

Fast Service, Sep. 1976, vol. 35, No. 9, Advertisement on p. 29.

Fast Service, May 1976, vol. 35, No. 5 Advertisement on p. 19.

*World Patent Index,* Access No. 82–23307e, Derwent Publications Ltd., London GB; JP–A–57 028 777 (Kishimoto) Feb. 16, 1982.

*Primary Examiner*—Anthony J. Weier

*Attorney, Agent, or Firm*—Lockwood, Alex, Fitzgibbon & Cummings

[57] ABSTRACT

A package, packaged food product and method are provided for packaging thinly sliced proteinaceous products such as sliced luncheon meats, cheeses and the like in a manner such that the thinly sliced products are supported by the packaging in a manner that resists shifting of the thinly sliced products within the package. The package has a generally wedge-shaped cavity into which a doubled-over shingled stack of the slices are sealed. Preferably, the package includes a semi-rigid panel and a flexible panel, at least one of which is generally transparent for displaying a substantial portion of the surface of at least one of the thin slices.

30 Claims, 2 Drawing Sheets

PACKAGING OF THINLY SLICED MEATS

This application is a continuation of application Ser. No. 696,327, filed on Apr. 30, 1991, now U.S. Pat. No. 5,395,632 which application was a continuation of Ser. No. 505,329, filed Apr. 5, 1990, now abandoned.

BACKGROUND AND DESCRIPTION OF THE INVENTION

The present invention generally relates to packages for hermetically sealing consumable products between generally opposing panels. More particularly, the invention relates to packages which are uniquely well suited to packaging thinly sliced proteinaceous materials such as sliced luncheon meat in a manner which protects the integrity of the thinly sliced proteinaceous material while simultaneously providing the consumer with the ability to observe a substantial portion of one of the slices of proteinaceous product and in order to see at least a shingled edge portion of most or all of the other slices. Typically, the package includes a semi-rigid panel which both supports and encloses the proteinaceous material, with the other panel typically being a flexible sheet through which the displayed proteinaceous product is visible. Proteinaceous materials such as sliced luncheon meats, sliced cheeses and the like have long been packaged between generally opposing panels which are vacuum packaged or gas flushed and hermetically sealed in a manner which permits relatively easy opening by the application of digital forces or the like so as to provide access to the proteinaceous products by the consumer. In many instances, these packages include rigid or semi-rigid components which define shaped cavities within which the stacked or shingled proteinaceous products are contained. Examples of these types of packages include those of U.S. Pat. Nos. 3,498,018 and 3,647,485 of Seiferth et al and 3,228,168 and 4,866,911 of Grindrod et al. In such packages, multiple proteinaceous products are arranged in stacks wherein the proteinaceous products are in one or more vertical stacks such that the proteinaceous products are directly one on top of another or are arranged in shingled fashion. In some instances, the packaging includes a vacuumizing procedure whereby a flexible film is pulled down over the stacked proteinaceous products in order to shape the film to closely overlie at least one face of the proteinaceous product stacks. Other packages are gas flushed, and both the rigid or semi-rigid package and the flexible panel are not substantially changed in shape during gas flushing to remove oxygen or other undesirable components from within the hermetically sealed package.

Vertically stacked or shingled products which have been packaged heretofore as discussed hereinabove have been used to package proteinaceous products other than those which are thinly sliced. Such customarily packaged proteinaceous products would typically have from about 8 to about 15 slices per inch of the vertical height of the stack. Thinly sliced proteinaceous products of the type suitable for packaging according to the present invention can be defined as including between about 22 and about 36 slices per inch of the vertical height of the stack.

Because of their thin and somewhat delicate nature, prior attempts to package thinly sliced proteinaceous products such as luncheon meat have not been particularly desirable. One example is that of products which are currently commercially available in which thinly sliced luncheon meat is packaged in a somewhat disorganized fashion between opposing flexible film panels. The haphazard manner in which these proteinaceous products are packaged and displayed tends to damage consumer confidence in the product, which can give the impression of a jumble of overly processed and/or restructured proteinaceous products. Consequently, at the present time, when a consumer wishes to purchase what is perceived to be a high quality luncheon meat and the like which is thinly sliced, it is necessary for that consumer to purchase products which are freshly sliced at a deli counter or the like.

One of the advantages of packaging proteinaceous products into neat stacks in which the face of at least one of the proteinaceous products is clearly displayed is that such a packaging approach allows the muscle texture or structure defined in a proteinaceous meat product to be easily seen and appreciated by the consumer prior to purchasing the packaged goods. Even if a proteinaceous product does have a perceived advantageous muscle definition, this attribute of the proteinaceous product would not be readily observable by the consumer prior to purchase and opening of the package when the packaging does not consistently display a large portion of a generally flat surface of a slice of the product.

There is a need for a packaging arrangement whereby thinly sliced proteinaceous products are packaged in a manner by which the product is arranged and maintained in neat stacks even during distribution through commercial trade channels and upon being handled by consumers in retail storage compartments and/or display racks. It would be desirable to provide such a package wherein the slices do not shift significantly during these types of normal commercial handling activities so as to provide a packaged product which enjoys enhanced consumer confidence both in the integrity of the package and the quality of the proteinaceous product therewithin.

In summary, the packages according to the present invention hermetically seal proteinaceous products between generally opposing panels, one of which is a semi-rigid panel and the other of which is a flexible film panel. The semi-rigid panel includes an enclosure area which is generally wedge-shaped. A peripheral flange area generally defines an access opening into this generally wedge-shaped enclosure area. The flexible film is secured to the peripheral flange in a manner by which a stack of thinly sliced proteinaceous items is hermetically sealed therewithin. The package-enclosing compartment thus formed has an overall configuration having a substantially flat face and a generally opposing face which has a substantial portion thereof that is inclined with respect to the flat face. This provides a generally wedge-shaped enclosure that closely conforms to the shape of and thereby supports a shingled stack of thinly sliced proteinaceous products, which stack is folded onto itself in generally doubled-up fashion in order to thereby form a folded stack which also has an overall wedge-shaped configuration. Typically, these packages will be arranged for display, such as by hanging from a peg or the like, according to an orientation in which the thickest depth of the wedge-shaped configuration accommodates the folded portion of the shingled stack, and the thinner depth section of the wedge-shaped enclosure accommodates the shingled edges of some of the shingled and folded slices. In an especially preferred embodiment, one of the panels is generally opaque, while the other panel is transparent, the transparent panel being the panel overlying the shingled edges of the folded stack.

It is accordingly a general object of the present invention to provide an improved semi-rigid package for thinly sliced proteinaceous products and to a method of forming such a package.

Another object of this invention is to provide an improved package and method of assembling same which is especially suitable for displaying thinly sliced luncheon meats and the like which are arranged in a shingled stack that is folded over onto itself.

Another object of the present invention is to provide an improved package and method which supports thinly sliced proteinaceous materials in a manner in which shifting of the slices is substantially prevented, even during distribution and marketing through commercial channels of trade.

Another object of the present invention is to provide a consumer attractive package which compactly displays at least a portion of substantially all of the slices of proteinaceous material stacked therewithin.

Another object of this invention is to provide an improved package and packaging method wherein the muscle definition of a meat product or the like is consistently visible from package to package.

These and other objects, features and advantages of the present invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
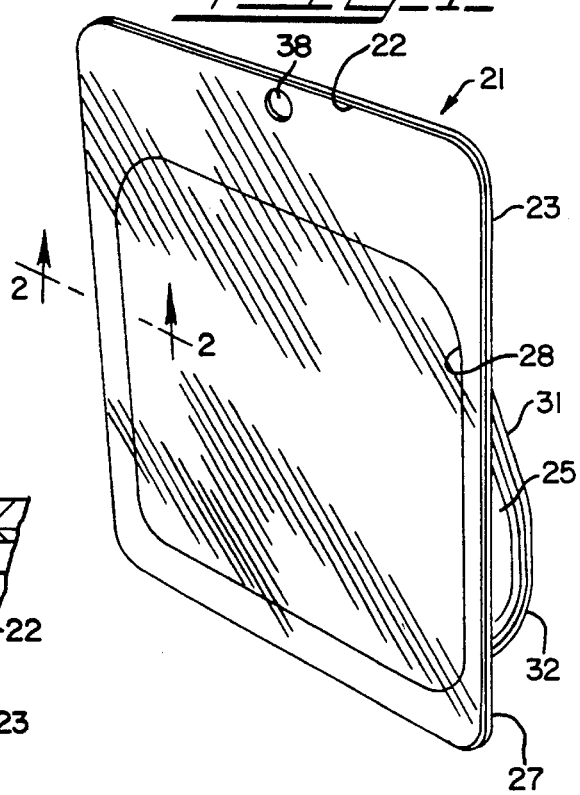
FIG. 1 is a perspective view of a package according to the present invention.

A package, generally designated as 21, is shown in FIG. 1. It includes a non-forming and flexible web panel or sheet 22 and a formed rigid or semi-rigid panel or web 23. As can be perhaps best understood from FIG. 3, a product-enclosing compartment 24 is defined between the flexible panel 22 and a generally wedge-shaped formation or bubble 25 formed into the semi-rigid panel or web 23. Products 26, such as the luncheon meat slices shown in FIG. 3, are then suitably enclosed within the generally wedge-shaped formation or bubble 25.

A flange 27 peripherally surrounds the generally wedge-shaped formation or bubble 25 of the semi-rigid panel 23. This peripheral flange 27 is perhaps best seen in FIG. 4. The non-forming flexible panel 22 is secured by suitable means to the surface of the peripheral flange 27 which opposes the flexible panel 22 when the package 21 is assembled. Suitable attachment means include heat and the heat sealable properties of the opposing panels and/or adhesive materials that are suitable for use on food packages. This sealing must be suitable to provide a hermetic joining of the panels 22 and 23, and it preferably is also peelable to the extent that the panels 22 and 23 can be readily separated by the application of digital forces directed in a manner so as to peel a portion or all of the flexible panel 22 away from the peripheral flange 27 in order to gain access into the product-enclosing compartment 24 and any product 26 contained therewithin. Product removal is achieved through an access opening 28, which is generally defined by the inside edge of the peripheral flange 27.

With more particular reference to the wedge-shaped character of the formation or bubble 25, such includes an inclined surface 31, which tapers into a somewhat U-shaped surface 32. There is thus provided a bubble compartment 25 which has a somewhat curved bottom portion providing a maximum compartment front-to-back thickness or depth. This somewhat bulbous bottom portion advantageously accommodates the product 26 in the area in which it is folded over onto itself. This bulbous configuration continues upwardly from the bottom of the generally wedge-shaped formation or bubble 25 for some distance until it tapers as the inclined surface 31 so that the compartment 24 has a minimum depth at its upper end.

Figure 3:
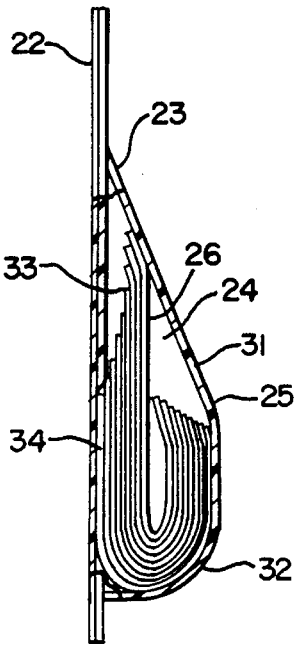
FIG. 3 is a side view, partially broken away, of the package according to FIG. 1 and showing shingled and folded slices of product therewithin.

With this structure, the product-enclosing compartment 24 is especially advantageous for enclosing a stack of thinly sliced proteinaceous products 26 which have been arranged in a shingled stack that is folded over onto itself in a manner such as that generally shown in FIG. 3. This product thus has a generally U-shaped bottom portion having a substantial thickness and a shape which generally conforms to shape defined by the somewhat U-shaped surface 32. The inclined surface 31 then helps to support the upper portion of the folded product 26, which is in particular need of support due to its shingled arrangement and the fact that it is otherwise not particularly well supported by the remainder of the folded shingled stack. For example, the portion of the inclined surface 31 can generally engage at least the uppermost shingled edge of the product 26.

Figure 4:
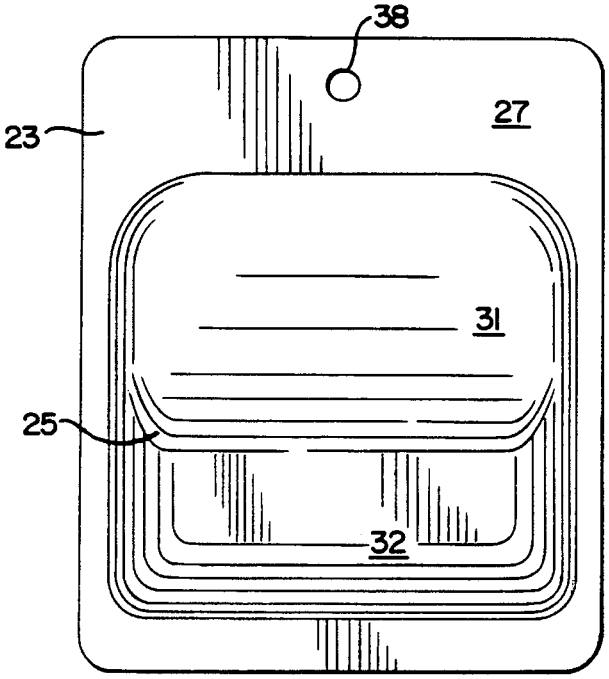
FIG. 4 is a plan view of the package from the semi-rigid panel side thereof.

In the embodiment illustrated in FIGS. 3 and 4, the non-forming flexible panel 22 is preferably transparent, and the formed, semi-rigid panel 23 is non-transparent to the extent that the folded-over face of the product 26 is not readily visible to the consumer. By the same token, the neat-looking shingled face of the folded product is visible through the flexible panel 22. In addition, depending upon the amount of labeling or other decorative indicia that may be printed upon or otherwise affixed to the transparent flexible panel 22, having this panel transparent will permit a clear viewing of about one-half of a substantially flat face of the slice of product which rests against the inside surface of the flexible panel 22.

A somewhat similar packaging arrangement which instills a comparable degree of consumer confidence in the integrity and evident acceptability of the packaged product can be achieved when the non-forming flexible panel is opaque or otherwise not transparent and when the formed semi-rigid panel is generally transparent. In such a situation, it would typically be preferred to reverse the orientation of the product 26 from that shown in FIG. 3 to the extent that the shingled face portion 33 faces and/or engages the inclined surface 31 of the package.

It will be appreciated that the product 26 intended to be stored within the product-enclosing compartment 24 takes the form of a plurality of very thinly sliced sheet-like items, any one of which would not readily remain in place without the support provided by the other slices and by the generally wedge-shaped formation or bubble 25. The thinness of the slicing can be between about 22 and about 36 slices per inch. Products of this type might be considered as having a disadvantage of not being particularly self-supporting. This apparent disadvantage is turned to an advantage in accordance with the present invention because this thinness facilitates the folding of the slices onto themselves into the shingled, folded generally U-shaped configuration illustrated, for example, in FIGS. 3, 5, 6 and 7. With this arrangement, even though the individual slices are unusually thin for many packaged food products, approximately one-half of one of the slices 34, 34' is visible through and may rest up against a panel of the package.

Figure 5:
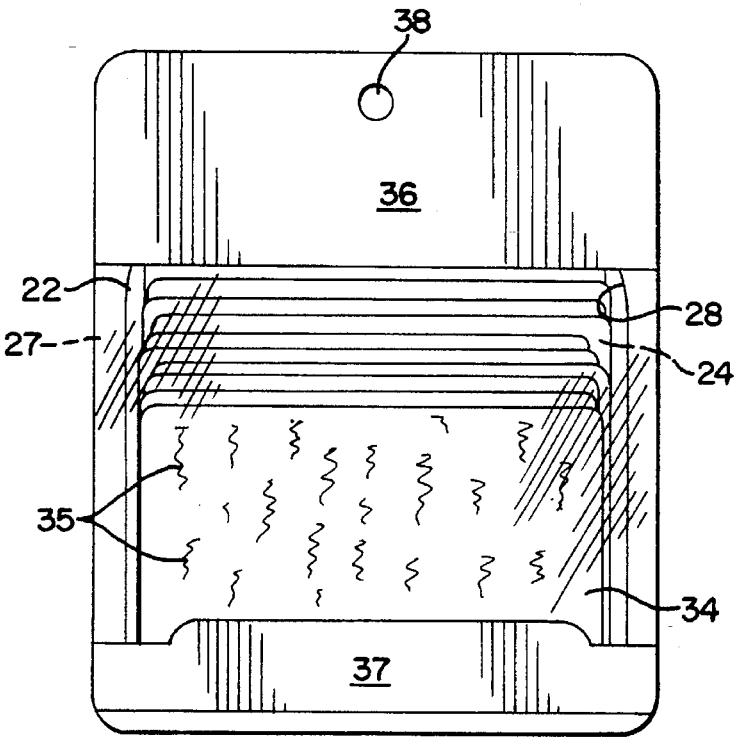
FIG. 5 is a plan view of a package according to the present invention, when viewed from the side of the flexible panel which is transparent and through which the shingled, folded stack of sliced product can be seen.
Figure 6:
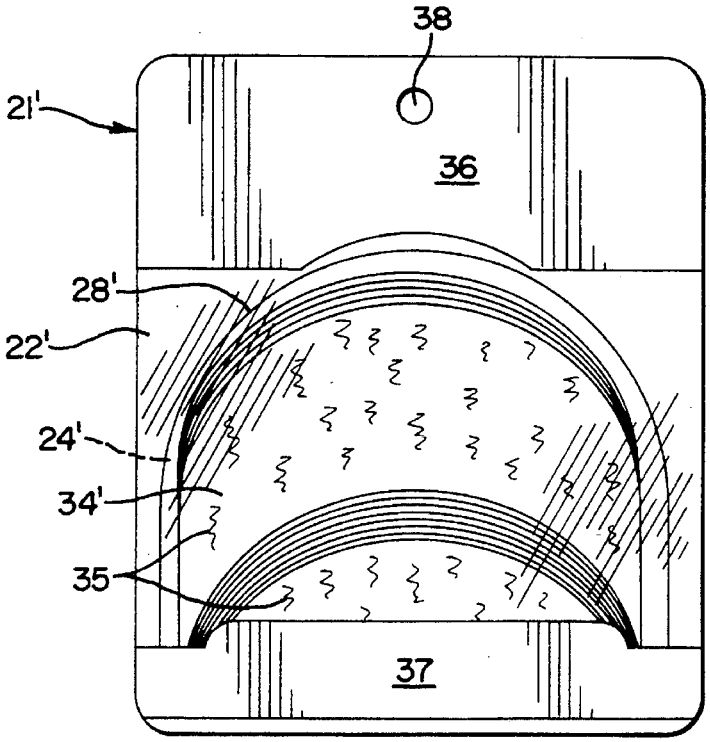
FIG. 6 is a view similar to that of FIG. 5 but showing an alternative embodiment.
Figure 7:
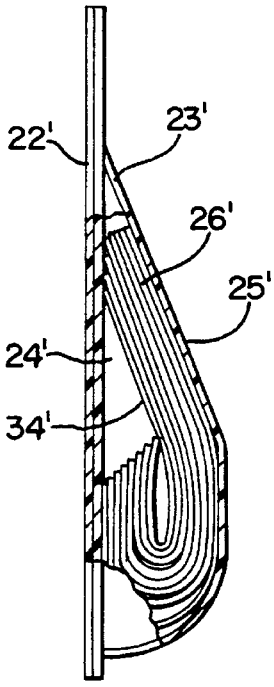
FIG. 7 is a side view, partially broken away, of the package according to FIG. 6.

As generally illustrated in FIGS. 5 and 6, the packages provide the consumer with an excellent opportunity to inspect the quality of the products prior to purchase, such as observing muscle definition 35. The embodiment of FIG. 5 is substantially the same as that shown in FIGS. 1 and 3, although adhesively secured or printed-on label members 36 and 37 are illustrated in FIGS. 5 and 6. Any number of labels can be included, as desired. In FIG. 5, the access opening 28 to the product-enclosing compartment 24 is generally rectangular in shape, whereas in FIG. 6, the access opening 28' to the product-enclosing compartment 24' has a generally arched configuration; that is, the upper portion thereof is substantially circular. This former embodiment is particularly well-adapted for sliced products in which each slice has a generally rectangular configuration, and the latter embodiment is particularly well-suited for sliced products which are generally circular in configuration. Other shapes might also be possible when it is desired to have the product-enclosing compartment 24 conform as closely as possible to the shape of the folded-over shingled stack of product. FIGS. 6 and 7 also illustrate another orientation of the sliced products 26' within a flexible panel 22' and a semi-rigid panel 23' and bubble 25' forming a package 21' having the compartment 24'.

As illustrated in the drawings, the packages preferably include a member for facilitating storage and display of a plurality of the packages. Illustrated in this regard is an orifice 38 of the type that is suitable for suspending the package from a generally horizontally oriented peg or the like in a manner that is well-known in the industry. When the package is suspended in a manner such as this, the combination of gravity and the overall general wedge shape of the product-enclosing compartment help to prevent damage to the thinner slices which are more likely to tear than thicker slices typically packaged in semi-rigid packaging. Once the shingled and folded thin slices are inserted into the product-enclosing compartment, the environment therewithin is treated such as by gas flushing or the like, and the flexible panel is sealed thereover, the package provides a substantially conforming environment which minimizes the chance that the individual slices will move within the product-enclosing compartment and thus be damaged. As can be seen in FIG. 3, the maximum thickness of the bulbous or generally U-shaped portion of the product-enclosing compartment is substantially the same as the thickness of the shingled and folded slices in the vicinity of the fold. This provides a close conformity condition which helps significantly in holding the product in place within the package. This condition is enhanced by the action of gravity upon the product within the suspended package which assists in maintaining the close relationship between the folded-over slices and the bulbous bottom portion of the product-enclosing compartment.

The panels forming the packages according to the present invention can be made from a variety of materials including files, multi-layered laminates or co-extrusions, thermoformable materials and the like. The flexible panel, which need not be shaped or shapable, is suitable for providing a flexible sheet which can be readily peeled away from the other panel. The other panel is made of a material which is formable into a shape including the flange and generally wedge-shaped bubble as described elsewhere herein. Neither or both of the panels could be transparent, but it is preferable that one of them be transparent so that at least the flat slice portion 34 or the like can be easily viewed by the consumer prior to purchase of the package. The panels should also be formulated so as to allow for the appropriate formation of a peel seal or other suitable means for hermetically sealing the panels together. A typical peel seal for packages of this type can range between about 1.0 and about 7.5 pounds/inch. In addition, the panels should provide a gas barrier, and particularly oxygen barrier properties.

Also, when it is desired to include printing, for displaying messages and/or for exhibiting coloration properties to one or both of the panels, the materials should be selected in order to achieve these objectives. It is often desirable that any such printing be affixed to an internal surface of a multi-layered panel so that the printing will be encapsulated within the panel. When so encapsulated, any such printing, coloration, or layer will be protected from contact with either the product within the package or with the environment outside of the package. By providing the printing or coloration at the interface between layers of a panel, the ink or the like will not interfere with the properties of the peel seal and will not cause any concerns for contacting same with a product such as food within the package. It is also possible to utilize coatings such as so-called varnish films in order to provide this type of protection for and/or from the ink or the like. The varnish-like overcoat can also be desirable when the film is of the so-called metallized type.

Figure 2:
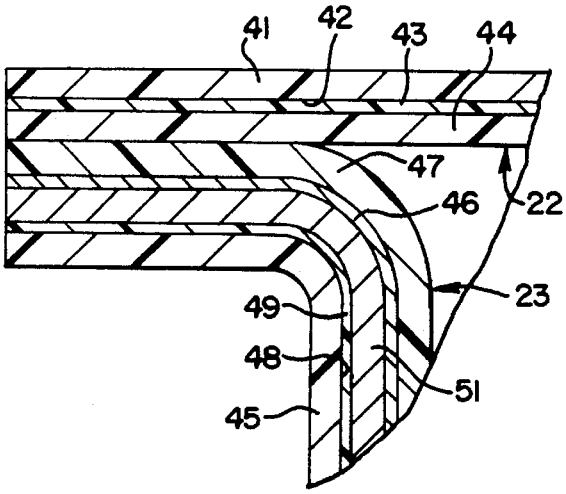
FIG. 2 is an enlarged, cross-sectional view along the line 2—2 of FIG. 1.

An example of non-forming web material suitable for forming the flexible panel 22 in accordance with this invention is a transparent lamination lid stock type of material. With reference to FIG. 2, the outside layer 41 can be a tough polymer, such as a printable polyester, for example one having a thickness of about 0.5 mil. When printing is desired, the ink 42 or the like is most advantageously printed onto the inside surface of the outside layer 41. Enhanced oxygen barrier properties can be achieved by a barrier coating 43, such as a coating of polyvinylidene chloride ("Saran") or of an ethylene vinyl alcohol copolymer (EVOH film). A so-called sealant layer or film is advantageously provided as the inside layer 44. Exemplary materials are polyethylene sealants, Surlyn (Ionomer), ethylene vinyl acetate copolymer (EVA) and the like, at a typical film or sealant thickness of about 2 mils.

The forming web is to be made of a material which can be readily formed in a manner well-known in the industry, such as within a form/fill/seal machine. A suitable outside layer 45 can be a polyamide material (nylon), a polypropylene or a polyester. It is desirable that such materials be tough and present a pleasing appearance. Generally these materials, without treatment such as metallization, will be transparent. A typical thickness is about 0.60 mil. In those instances when the forming web is to be transparent and not colored or metallized, this layer can be omitted. A barrier coating 46 on the order of the barrier 43 can be advantageously provided. In addition, an inside layer 47 similar to inside layer 44 of the non-forming panel is also typically provided. Opposing surfaces 44 and 47 which are provided at the peripheral flange area of the package are similar but not identical in order to facilitate maintenance of a peelable seal, as opposed to a permanent seal.

A non-transparent condition can be imparted, such as to the forming panel, by including coloration layers or the like. As an example, the outside layer 45 can have a metallized coating or layer 48 thereon, such as one imparting a silver color which is readily visible through the outside layer 45. Additional coloration can be imparted by including an ink layer 49, such as one having a generally orange color which imparts a gold-appearing colored layer that is be visible through transparent layer(s) of the formed panel so that the coloration can be seen on the inside surface and the flange area of the formed panel 23. A forming layer 51 is also preferably included, such being typically transparent. Exemplary materials suitable for such a layer are copolyesters such as Kodar A150, rigid polyvinylchloride (PVC), Barex, and other polyester components.

It will thus be seen that the present invention provides new and useful packaging having advantageous properties and characteristics, including those pointed out herein and others which are inherent in the invention. Preferred embodiments of the invention have been described by way of example, and it is anticipated that modifications may be made to those described herein without departing from the spirit of the invention or the scope of the appended claims.

We claim:

1. A packaged food product wherein thinly sliced proteinaceous products are hermetically sealed between generally opposing panels, comprising:

a formed panel member having an enclosure bubble cavity, said cavity having a planar access opening on one side thereof, and a substantially planar peripheral flange which surrounds and defines said access opening of said enclosure bubble cavity and is substantially in the plane of said planar access opening;

a substantially flat planar panel member overlying said planar peripheral flange and said access opening of the enclosure bubble cavity to thereby close said cavity;

means for sealing said substantially flat planar panel member to said planar flange of the formed panel member; and a stack of thinly sliced proteinaceous products hermetically sealed within a compartment defined by said enclosure bubble cavity and said substantially flat planar panel member, said stack being folded up onto itself into a doubled-over configuration and in which the edges of a substantial number of said slices are in offset shingled relationship to each other with the direction of said offset being substantially parallel to the direction in which said stack is folded up onto itself.

2. The packaged food product according to claim 1, wherein at least a portion of at least one of said panel members is transparent to permit viewing of said proteinaceous products in said package.

3. The packaged food product according to claim 1, wherein said doubled-over shingled stack of thinly sliced proteinaceous products has a maximum doubled-over thickness which is generally equal to a maximum depth of the enclosure bubble cavity.

4. The packaged food product according to claim 1, wherein said flat planar panel member is a non-shapable multi-layered panel of a polyester outside layer, a sealant film inside layer, and a gas-barrier layer therebetween; and wherein said formed panel member is a shapable multi-layered panel of a tough polymer web outside layer, a sealant film inside layer and multiple layers therebetween, said multiple layers therebetween including a gas-barrier layer, a coloration layer, and a forming layer.

5. The packaged food product according to claim 4, wherein said coloration layer includes a metallized component.

6. The packaged food product according to claim 1, wherein said thinly sliced proteinaceous products are luncheon meat slices having a thickness of between about 22 and about 36 slices per inch.

7. The packaged food product according to claim 6, wherein said cavity is gas flushed and hermetically sealed.

8. The packaged food product according to claim 1, wherein at least one of said panel members is flexible.

9. The packaged food product according to claim 8, wherein said flat planar panel member is flexible.

10. The packaged food product according to claim 8, wherein one of said panel members is flexible and the other is semi-rigid.

11. The packaged food product according to claim 10, wherein said formed panel member is semi-rigid.

12. The packaged food product according to claim 1, including means for supporting the package for display so that said panel members extend in a substantially vertical direction.

13. A method for packaging thinly sliced proteinaceous products in a package comprising:

forming a panel member having an enclosure bubble cavity, said cavity having a planar access opening on one side thereof, and a substantially planar flange which surrounds and defines said access opening of said enclosure bubble cavity and which is substantially in the plane of said planar access opening;

forming a stack of thinly sliced proteinaceous products which is folded up onto itself into a doubled-over configuration and in which a substantial number of said slices are in offset shingled relationship to each other with the direction of offset being substantially parallel to the direction in which the stack is folded upon itself;

depositing the doubled-over shingled stack within said bubble cavity of the formed panel member;

overlying a substantially flat planar panel member over the access opening to thereby enclose the doubled-over shingled stack between the substantially flat planar panel member and the enclosure bubble cavity of the formed panel member; and sealing the substantially flat planar panel member to the flange of the formed panel member.

14. The method according to claim 13, wherein at least a portion of at least one of the panel members is transparent to permit viewing of said proteinaceous products in the package.

15. The method according to claim 13, wherein said thinly sliced proteinaceous products comprise slices of luncheon meat having a thickness of between about 22 and about 36 slices per inch.

16. The method according to claim 13, further including gas flushing the enclosure bubble cavity.

17. The packaged food product according to claim 1, wherein said stack is a shingled stack of said slices which are folded up onto themselves into said doubled-over configuration.

18. The packaged food product according to claim 1, wherein said shingled doubled-over stack configuration includes a perimeter configuration about the stack and a cross-sectional configuration in thickness, and said compartment also includes a perimeter configuration and a cross-sectional configuration in depth substantial portions of which are of substantially the same shape and size as the respective perimeter and cross-sectional configurations of the stack and such that the configuration of said stack and compartment compliment each other at said portions, whereby the stack is closely confined in said compartment against movement.

19. The packaged food product according to claim 18, wherein the perimeter configurations of said stack and compartment are asymmetric along at least one axis.

20. The packaged food product according to claim 18, wherein the thickness of said stack of shingled, doubled-over slices and the depth of said compartment each vary at different locations in said bubble cavity in a manner to compliment each other, whereby said stack at such different locations is closely adjacent said panel members to confine the stack against movement.

21. The packaged food product according to claim 18, wherein said stack is supported in said compartment on a portion of its perimeter which is unshingled when said panel members extend in a substantially vertical direction.

22. The method according to claim 13, including stacking a plurality of thinly sliced proteinaceous products one on top of another and offsetting said slices with respect to each other so as to form a shingled stack of the thinly sliced proteinaceous products; and folding the shingled stack generally onto itself in order to form said doubled-over offset shingled stack.

23. The method according to claim 13, wherein said shingled, doubled-over stack configuration includes a perimeter configuration about the stack and a cross-sectional configuration in thickness, a compartment is defined by said enclosure bubble cavity and substantially flat planar panel, said compartment also including a perimeter configuration and a cross-sectional configuration in depth substantial portions of which are of substantially the same shape and size as the respective perimeter and cross-sectional configurations of the stack and such that the configurations of said stack and compartment compliment each other at said portions, whereby the stack is closely confined in said compartment against movement.

24. The method according to claim 23, wherein the perimeter configurations of said stack and compartment are asymmetric along at least one axis.

25. The method according to claim 23, wherein the thickness of said stack of shingled, doubled-over slices and the depth of said compartment vary at different locations in said bubble cavity in a manner to compliment each other, whereby said stack at such different locations is closely adjacent said panel members to confine the stack against movement.

26. The method according to claim 23, including supporting said package so that said panel members extend in a substantially vertical direction; and supporting said stack on a portion of its perimeter which is unshingled when said panel members extend in a substantially vertical direction.

27. The packaged food product according to claim 17, wherein at least some of the slices of the stack are offset from each other along a longitudinal axis to shingle the slices relative to each other and the stack is folded upon itself in a direction substantially parallel to said axis.

28. The method according to claim 22, wherein said folding step folds the shingled stack at a location at which a generally shingled front portion of the doubled-over shingled stack projects beyond a back portion of the doubled-over shingled stack.

29. The method according to claim 22, wherein said folding step folds the shingled stack at a location at which a generally shingled back portion of the doubled-over shingled stack projects beyond a front portion of the doubled-over shingled stack.

30. The method according to claim 22, wherein at least some of the slices of the stack are offset from each other along a longitudinal axis to shingle the slices relative to each other and the stack is folded upon itself in a direction substantially parallel to said axis.

* * * * *

UNITED STATES PATENT AND TRADEMARK OFFICE

CERTIFICATE OF CORRECTION

PATENT NO. : 5,558,891

DATED : September 24, 1996

INVENTOR(S) : Brian P. Lawless, Heidi A. Schmidt, Gary G. Winchester and Kenneth E. Woode It is certified that error appears in the above-indentified patent and that said Letters Patent is hereby corrected as shown below:

On the Cover Sheet, under "OTHER PUBLICATIONS", delete "Professional-Cooking" and insert --Professional Cooking--.
Col. 6, line 3, delete "files" and insert --films--.

Signed and Sealed this

Second Day of December, 1997

Bruce Lehman

BRUCE LEHMAN

*Commissioner of Patents and Trademarks*

*Attest:*

*Attesting Officer*